United States Patent [19]

Callery

[11] 3,945,617

[45] Mar. 23, 1976

[54] MIXING METHOD AND MEANS

[76] Inventor: Thomas R. Callery, 14 Rectory Lane, Scarsdale, N.Y. 10583

[22] Filed: Jan. 14, 1974

[21] Appl. No.: 433,080

[52] U.S. Cl. ..... 259/54; 215/100 R; 222/570

[51] Int. Cl.[2] ..... B01F 15/00

[58] Field of Search ..... 259/54, 55, 56, 57, 58, 259/59, 72, 48; 222/570; 215/100 R, 31; 285/235, 236, DIG. 12; 141/319, 364

[56] References Cited

UNITED STATES PATENTS

| | | | |
|---|---|---|---|
| 1,865,023 | 6/1932 | Leavy | 215/100 R |
| 3,337,039 | 8/1967 | Knittel | 259/54 X |
| 3,615,150 | 10/1971 | Indrunas | 141/364 X |
| 3,700,215 | 10/1972 | Hardman | 259/98 |
| D123,965 | 12/1940 | Teunisz | 215/31 X |

FOREIGN PATENTS OR APPLICATIONS

| | | | |
|---|---|---|---|
| 377,422 | 7/1932 | United Kingdom | 285/235 |
| 691,860 | 8/1964 | Canada | 285/DIG. 12 |
| 1,289,512 | 2/1962 | France | 215/31 |

*Primary Examiner*—Stanley N. Gilreath
*Assistant Examiner*—Alan Cantor
*Attorney, Agent, or Firm*—McDougall, Hersh & Scott

[57] ABSTRACT

The mixing of materials pre-packaged in precise amounts in separate vials. Use is made of an adaptor of resilient material in which a pair of vials are releasably engaged in sealing relation, in end-to-end relation, with a communicating passage therebetween. The assembled adaptor and vials can be shaken to effect the desired intermixing of the materials present in the vials without loss of material or contamination. Thereafter the mixture can be located in one vial and the adaptor separated from the vials for re-use.

3 Claims, 2 Drawing Figures

MIXING METHOD AND MEANS

This invention relates to a method and means for admixture of precise amounts of material immediately prior to use.

Very often, two or more materials are required to be admixed one with another in precise amounts prior to use. Ordinarily, such precise amounts of material can be introduced in a single container in which they are admixed for subsequent use. However, where such admixture of materials leads to undesirable change, deterioration or reaction, it is necessary to maintain the materials in a separated relation for mixing immediately prior to use. This is experienced often times in various medical, clinical and testing procedures where mixtures of liquids, oils, powders, or other flowable materials are required to be combined in precise amounts for various treatments, tests or analysis, where the materials cannot be pre-packaged as a pre-mix.

Under such circumstance, it has been necessary to effect measurement of the desired amounts of material from bulk at the station of use, as by pouring, pipetting, weighing, or the like, with the result that the procedure is subject to inaccuracies and/or error and the materials are exposed to possible contamination by elements coming into contact therewith during measurement and transposition to the mixing means.

It is an object of this invention to provide a device which enables the materials to be admixed to be pre-packaged in precise amounts in separate containers in which they are sealed. Such measurement of precise amounts and pre-packaging in separate containers can be effected in a mass production process, with automatic equipment, whereby precise measured amounts of material are introduced into each container with immediate sealing. Such separately pre-packaged material is characterized by long shelf life to enable storage and shipment over extended periods of time and to enable large inventories of such precise amounts of pre-packaged material to be maintained at the station of use.

Figure 1:
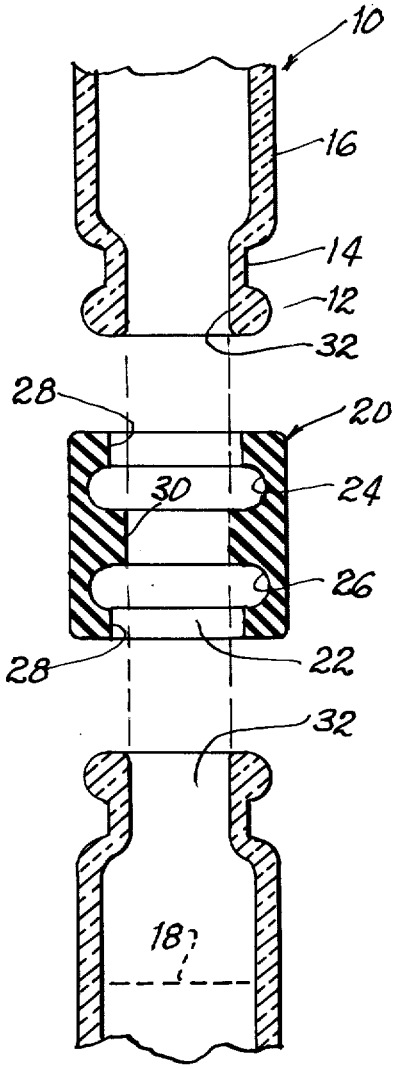
Figure 2:
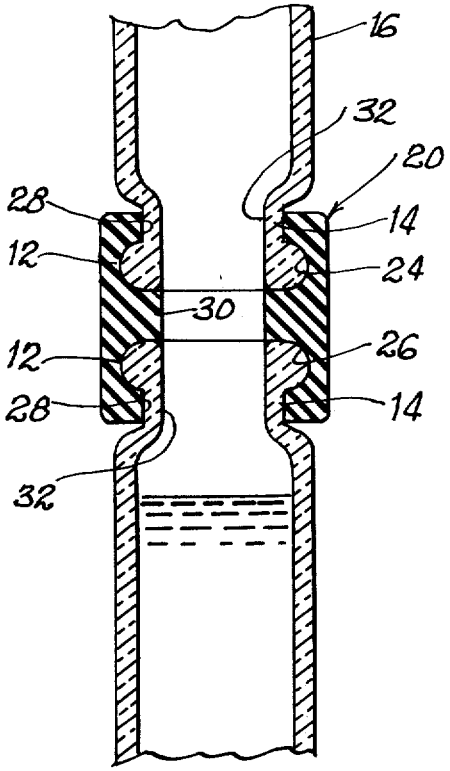

These and other objects and advantages of this invention will hereinafter appear, and for purposes of illustration, but not of limitation, an embodiment of the invention is shown in the accompanying drawing, in which FIG. 1 is a schematic sectional elevational view of the relative arrangement of elements employed in the practice of this invention, and FIG. 2 is a sectional elevational view showing the open ends of the vials in operative engagement with the adaptor for intercommunication between the interior of the vials for intermixing the materials originally contained in the separate vials.

In accordance with the practice of this invention, use is made of vials 10, open at one end, and which are defined by an annular lip portion 12 connected by a neck portion 14 of smaller diameter to a body portion 16 of the desired capacity for the amount of material to be packaged therein and preferably of larger wall-to-wall dimension than the lip portion. The vial 10 can be formed of glass, plastic, or other relatively rigid structural material with a body portion of rounded, rectangular, or other geometrical shape.

A material 18 to be admixed, in fluid form such as a liquid, solvent, oil, powder, or other particulate substances, is pre-loaded into the vial in precise amounts, as by means of an automatic filling machine, after which the vial is sealed, as by means of a cork, stopper, cap, plastic film or the like for shipment and storage until use.

Use is made of an adaptor 20 in the form of a cylindrical section having a central bore 22 extending continuously therethrough. A pair of axially spaced annular grooves 24 and 26, of curvilinear cross section, extend outwardly continuously from the bore 22, with the grooves being shaped to correspond with the contour of the lip portion 12, and dimensioned to correspond and preferably to be slightly less in the crosswise dimension than the outside wall-to-wall dimension of the lip 12, to enable the lip portion to be received therein in gripping or sealing relation. The grooves 24 and 26 are each spaced inwardly from the opposite ends of the adaptor by a distance corresponding to the length of the neck portion 14 of the vial and preferably slightly less, with the inside diameter of the portion 28 beyond the grooves to the ends of the adaptor corresponding to the outer wall-to-wall dimension of the neck portion 14 of the vial and preferably slightly less, so as to provide a gripping relation therebetween when the vial is inserted in position of use in the adaptor with the lip portion 12 seated within the groove. The portion 30 between the axially aligned grooves 24 and 26 is dimensioned to have a diameter corresponding to the diameter of the opening 32 at the outlet through the neck portion of the vial and a length sufficient to maintain the grooves 24 and 26 in separated relation, such as a distance within the range of ⅛ inch to ¼ inch and preferably ¼ inch to ½ inch. The spaced relationship between the grooves 24 and 26 is not critical, it being sufficient to maintain the lip portions of the vials out of contact one with the other when disposed in the grooves, but sufficient to permit relative movement while in the adaptor to facilitate the insertion and removal of the vials from the adaptor.

The adaptor 20 is preferably molded or otherwise formed as a unitary structure of a flexible material which is not in any way reactive or otherwise affected by the materials in the vials or a mixture thereof. For this purpose, the adaptor can be formed, as by molding, of a rubber-like material or a plastic material characterized by a sufficient degree of resiliency to enable flexure of the end portions to facilitate the insertion or removal of the lip portions of the vials into and out of the grooves respectively. Suitable materials include polyethylene, polypropylene, ethylene-propylene copolymer, polyurethanes, polyesters and the like plastic materials, or polyisoprene, butyl rubber, butadiene-styrene copolymer, butadieneacrylonitrile copolymer, EPDM rubbers, polychloroprene and the like elastomeric materials and blends thereof.

It is preferred to standardize on the dimensional characteristics of the vials, especially with respect to the neck and lip portion so that the adaptor can be standardized to have bores and grooves of the same dimension. In the event that vials are employed which have neck portions and lips which differ in dimension, then adaptors must be stock-piled with bores and grooves of different dimensional characteristics corresponding to the various vials which may be used.

As illustrated in the drawing, in use, the closure is removed from one of the vials and the adaptor 20 is displaced endwise onto the open end of the vial. As the adaptor is forced downwardly over the open end of the vial, the lip portion 12 of the vial causes flexure of the engaged end portion of the adaptor until the lip snaps into position as it becomes seated in gripping relation within the groove, with the portions of the adaptor in between gripping the adjacent neck portion of the vial all around to effect a sealing engagement therebetween.

The other vial is unsealed and the open end is brought into engagement with the other end of the adaptor, as by inclining the adaptor with the previously assembled vial and dipping the lip of the other vial into the open end of the adaptor in a manner to bring the two together until the lip snaps into the groove for interengagement in sealing relation.

Instead, after the first vial has been joined in sealing relation to the adaptor, the other vial can be dipped to pour the measured amount of material therefrom through the open end of the adaptor. Thereafter the second vial can be positioned with the lip portion immediately above the open end of the vial, as illustrated in FIG. 1, whereupon the lip snaps into sealing engagement into the upper groove as the vial is displaced in the downwardly direction into the open end of the adaptor.

Now both vials are joined with the adaptor with the open ends of the vials in adjacent end-to-end, facing relation with only the short intermediate section 30 of the adaptor in between.

Under these conditions, the assembly can be rocked to effect the displacement of material from one vial to the other while shaking the assembly to achieve uniform admixture of material if in solid and/or liquid form, or to effect solution of one material with the other, and the like. Such solution or admixture is achieved with the precisely measured amounts of material in the vials, and without handling of the materials or exposure of the materials in a manner which might otherwise cause loss of material or contamination.

When the desired admixture or solution has been completed, the assembly can be up-ended to cause all of the material to flow into the lower vial. The assembly can be removed from the lower vial as by gripping the adaptor adjacent the lip portion of the upper vial and then bending the assembly downwardly about the lip portion of the lower vial while twisting whereupon the assembly will slip off the lower vial, leaving it free to enable the mixture or solution to be poured from the vial or otherwise to make use of the mixture.

The adaptor can be freed of the upper vial by pushing the ends of the adaptor off of the vial or by bending and twisting the adaptor as previously described for removal from the lower vial.

The adaptor can be washed and/or sterilized for use over and over again.

By way of example, for use with vials of the following dimensions:

| | |
|---|---|
| Body portion, outside diameter | 1-5/16 inches |
| Neck portion, outside diameter | 15/16 inch |
| Neck portion, length | 1/4 inch |

-continued

| | |
|---|---|
| Lip portion, maximum outside diameter | 1-1/4 inches |
| Lip portion, height | 5/16 inch |
| Inside diameter of mouth of vial | 11/16 inch |

The following dimensional characteristics would be embodied in adaptors for use with vials having the dimensional characteristics described above:

| | |
|---|---|
| Diameter of bore beyond the grooves | 7/8 inch |
| Maximum diameter of grooves | 1-3/16 inches |
| Diameter of bore between grooves | 11/16 inch |
| Length of bore beyond the grooves | 1/4 inch |
| Length of bore between the grooves | 1/8 to 5/8 inch |

It will be noted that in the above specifications, the adaptor is one-sixteenth inch less in diameter than the corresponding portions of the bores and grooves of the vial. This is for the purpose of establishing a resilient gripping relationship therebetween with provisions to minimize crevices between the vial and adaptor in position of use, so as to minimize entrapment of material.

It will be understood that changes may be made in the details of construction, arrangement and operation without departing from the spirit of the invention, especially as defines in the following claims.

I claim:

1. For use in intermixing flowable content material from separate vials having a body portion, a neck portion of smaller internal diameter than the body portion to provide an access opening of lesser diameter than the interior of the vial, and a lip portion on the end of the neck portion of larger diameter than the neck portion, with an access opening extending through the lip and neck portion into the body portion, an adaptor of rigid resilient material having a passage extending continuously therethrough including a pair of axially spaced grooves shaped to correspond to the outer contour of the lip portion of the vials and having an inner wall-to-wall diameter within the range of slightly less than to up to the outer wall-to-wall diameter of the outer lip portion of the vials, expandable portions beyond the grooves at the ends of the passage having a diameter within the range of slightly less than to up to the outer wall-to-wall diameter of the neck portion of the vials and a length no greater than the length of the neck portion of the vials, while the portion between the grooves has a length dimensioned to space the grooves one from the other and a diameter corresponding to the diameter of the access opening of the vials to provide for a continuous passage of uniform dimension between the access openings of the vials when in the adaptor.

2. An adaptor as claimed in claim 1 in which the portion of the passage between the grooves is dimensioned to have a length within the range of ⅛ to ¾ inch.

3. An adaptor as claimed in claim 1 in which the portion of the passage between the grooves is dimensioned to have a length within the range of ¼ to ½ inch.

* * * * *